US005622603A

United States Patent [19]

Begemann et al.

[11] Patent Number: 5,622,603

[45] Date of Patent: Apr. 22, 1997

[54] INFLUENCING THE JET VELOCITY IN THE MULTILAYER HEADBOX

[75] Inventors: Ulrich Begemann, Leonberg; Albrecht Meinecke, Heidenheim; Dieter Egelhof, Heidenheim; Wolfgang Ruf, Heidenheim; Helmut Heinzmann, Böhmenkirch, all of Germany; Hans-Peter Arledter, St. Pölten, Austria

[73] Assignee: J.M. Voith GmbH, Heidenheim, Germany

[21] Appl. No.: 325,305

[22] PCT Filed: Mar. 3, 1994

[86] PCT No.: PCT/EP94/00616

§ 371 Date: Mar. 27, 1995

§ 102(e) Date: Mar. 27, 1995

[87] PCT Pub. No.: WO94/20678

PCT Pub. Date: Sep. 15, 1994

[30] Foreign Application Priority Data

Mar. 6, 1993 [DE] Germany ..... 43 07 143.0

[51] Int. Cl.[6] ..... D21F 1/02

[52] U.S. Cl. ..... 162/343; 162/216; 162/344

[58] Field of Search ..... 162/216, 336, 162/343, 344

[56] References Cited

U.S. PATENT DOCUMENTS

| | | | |
|---|---|---|---|
| 3,598,696 | 8/1971 | Beck | 162/343 |
| 3,843,470 | 10/1974 | Betley et al. | 162/343 |
| 4,181,568 | 1/1980 | Pfaler | 162/343 |
| 4,376,014 | 3/1983 | Bergstrom | 162/343 |
| 4,765,868 | 8/1988 | Fujiwara | 162/343 |
| 5,074,965 | 12/1991 | Keskiivari et al. | 162/343 |
| 5,431,785 | 7/1995 | Bubik et al. | 162/343 |

FOREIGN PATENT DOCUMENTS

| | | |
|---|---|---|
| 581051 | 2/1994 | European Pat. Off. . |
| 2824608 | 1/1979 | Germany . |
| 3101407 | 7/1982 | Germany . |
| 3704462 | 8/1988 | Germany . |

*Primary Examiner*—Karen M. Hastings
*Attorney, Agent, or Firm*—Baker & Daniels

[57] ABSTRACT

The invention concerns a method of controlling the relative flow speed of the layers in a multi-layer headbox with laminae mounted torque-free between upper and lower lips which are stationary when in operation. The invention is characterized in that a difference in speed is produced between the individual layers by causing the static pressure to change differently in the different layers.

10 Claims, 3 Drawing Sheets

INFLUENCING THE JET VELOCITY IN THE MULTILAYER HEADBOX

BACKGROUND OF THE INVENTION

The invention concerns a multilayer headbox of a paper machine with a slice nozzle subdivided by lamellae of flexible installation, in which slice nozzle there is for each stock suspension an aperture space provided which extends across the machine width. Furthermore, the invention concerns a method for adjusting the relative velocities of the individual stock suspensions at the nozzle exit.

A headbox of that type is known, e.g., from DE-OS 37 04 462. Its aperture spaces being supplied independently from one another with stock suspensions, said headbox serves the manufacture of multilayer paper webs. To adjust different velocities and pressures of the stock suspension in the individual spaces, the lamellae between individual aperture spaces are pivotable about their longitudinal axis and are manually adjusted from outside. Disadvantageous is here that, when the quantity passing through the headbox changes, the interrelationship of stock suspension velocities between individual layers changes, requiring readaptation by manual adjustment. A further disadvantage is that the necessary accuracy of adjustment cannot be achieved at all or only at extraordinary expense.

Moreover, reference is made to patent document DE 31 01 407 A1. This document depicts a multilayer headbox whose built-in lamellae are installed flexibly. The lamellae shown there, however, aim to maximally equalize the flow velocities of the different layers.

Hence, it is also known to fashion the lamellae in the aperture space flexible across their entire length, allowing them to automatically adjust in such a way that equal pressure prevails at any point in all aperture spaces. A flow adjustment in the individual nozzle spaces and a mutually independent adjustment of the exit gaps for the individual paper layers, however, is not possible thereby.

For some time now it has been desired to influence the velocities of the individual jets of a multilayer headbox in such a way that the differential velocities between individual jets will change. In the cited prior art this is carried out by manual adjustment of the individual lamellae. It shows here, however, that it is very difficult to adjust the lamellae, which are up to 10 meters long, to the necessary accuracy of a few hundredths of a millimeter against the forces of flow in a fashion which is constant across the machine width. Furthermore, altering the conditions of throughput leads to different velocity ratios between individual layers, whereby readjustment becomes necessary.

SUMMARY OF THE INVENTION

Reasons for the necessity of influencing the velocity of the individual stock suspension layers are:

The formation also is a function of the velocity differences between individual stock suspension layers. The variation of shear forces possible thereby, between liquid layers, generates turbulences which affect the formation, which allows an influencing of the paper web formation that may be desired.

Variation of the flow velocity of an outside layer influences the orientation and lengths of the semiaxes of the break length ellipses of the paper web, depending on the size of the jet angle and the jet-wire speed differential. Said break length ellipses, in turn, correlate with the orientation and statistical distribution of the fibers about the major direction in the outer layer. Possible is thus an influencing of the mechanical properties of the paper web.

When drying, a paper web shrinks preferably in the direction transverse to the fiber orientation, that is, it deforms at moisture changes in accordance with this property. With the fiber orientation and distribution differing in the outer layers of a paper web, the so-called "curl," that is, the tendency of a paper to roll at moisture changes, of a sheet will be favored. Therefore, the curl tendency can be influenced as well by velocity changes.

The problem underlying the invention is to provide a method for influencing the flow velocities of the individual layers of a multilayer headbox which is broadly independent of the amount of stock suspension throughput through the headbox. A further problem of the invention is to provide a multilayer headbox for application of the aforementioned method.

These problems are solved by the features of the present invention.

The inventors have recognized that the velocity differences between individual jets issuing out of the headbox nozzle are constant in the individual layers of the headbox, irrespective of the volume flows, when using lamellae that are rigid in themselves but installed in no-moment fashion. Thus, an additional correction of the lamellae position with changing volume flows is not necessary. The pivot of the lamellae must not necessarily be situated at the nozzle entrance, as shown in FIGS. 1 through 4, but may be situated also in the nozzle.

Moreover, the inventors recognized that desired velocity differences can be prescribed within a broad range. Measures of this type can be divided in two categories:

I. Changing the coefficients of resistance of the individual nozzles, for instance by:
   - changing the length of the lamella section protruding out of the nozzle;
   - changing the viscosity of the partial volume flows; or
   - definitive variation of the slice geometries of the outer layers through the use of an aperture.

II. Changing the pressure pattern along the rigid lamella in the nozzle, for instance by:
   - giving the lamellae on both sides a different profile;
   - shaping the nozzle inside wall.

BRIEF DESCRIPTION OF THE DRAWINGS

The invention will be more fully explained hereafter with the aid of the drawings, which show in.

DETAILED DESCRIPTION OF THE PREFERRED EMBODIMENTS

Figure 1:
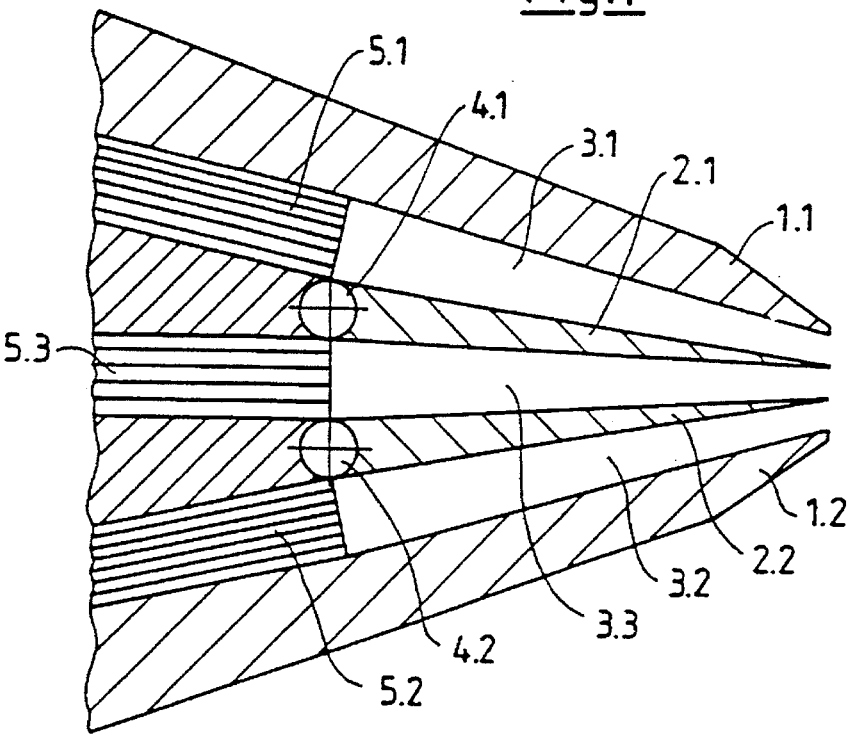
FIG. 1, individual nozzles with equal geometries.

FIG. 1 shows a triple-layer slice nozzle in cross section, with upper lip 1.1 and lower lip 1.2. Arranged symmetrically between upper and lower lip are the three turbulence inserts 5.1, 5.2 and 5.3 which feed the stock suspension. Mounted between the turbulence inserts, on their slice part, with no-moment mounting 4.1 and 4.2 are the rigid lamellae 2.1 and 2.2 tapering evenly toward the exit end, their front ends being flush with the equally long upper and lower lips, said lamellae forming together with the upper and lower lip the individual nozzles 3.1., 3.2 and 3.3. The headbox, notably the individual nozzle shapes, are in this case absolutely symmetric.

FIG. 2 shows again a triple-layer stock suspension nozzle in cross section, with upper lip 1.1 and lower lip 1.2. Arranged symmetrically between upper and lower lip are the three turbulence inserts 5.1, 5.2 and 5.3 feeding the stock suspension. Mounted between the turbulence inserts on their exit part with no-moment mounting 4.1 and 4.2 are the rigid lamellae 2.1. and 2.2, their front ends being flush with the equally long upper and lower lips, and said lamellae forming together with the upper and lower lip the individual nozzles 3.1, 3.2 and 3.3. In this example, the upper lamella 2.1 has a convex shape causing a constriction in the upper nozzle 3.1, which induces a velocity increase of the respective layer. FIG. 2*a* shows a similar arrangement, except in this case the upper lamella 2.1 has a concave shape causing an expansion in the upper nozzle 3.1, which causes a velocity decrease of the respective layer.

Figure 2:
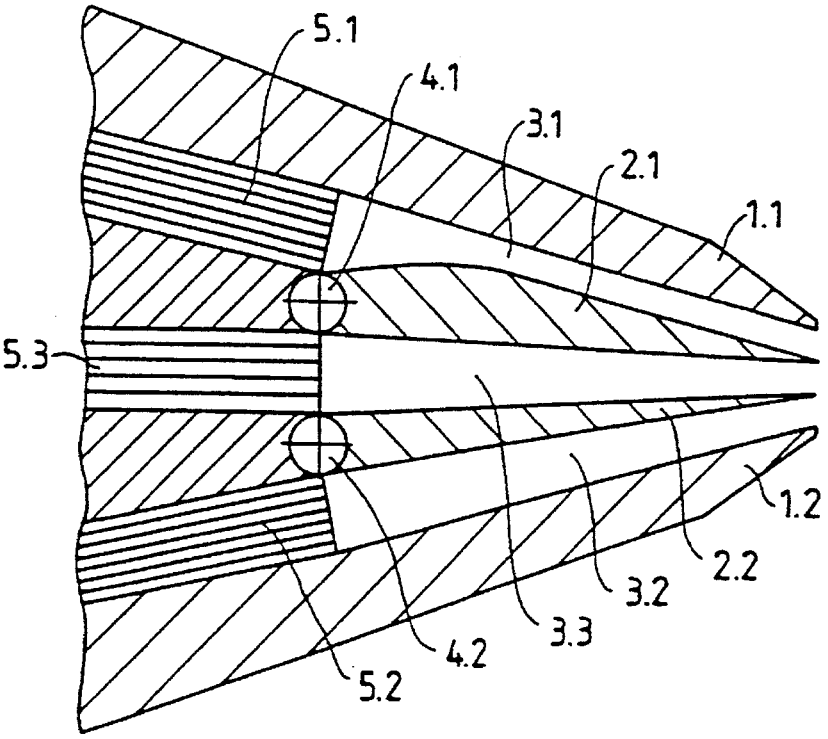
FIGS. 2 and 2*a*, individual nozzles with different geometries.
Figure 2A:
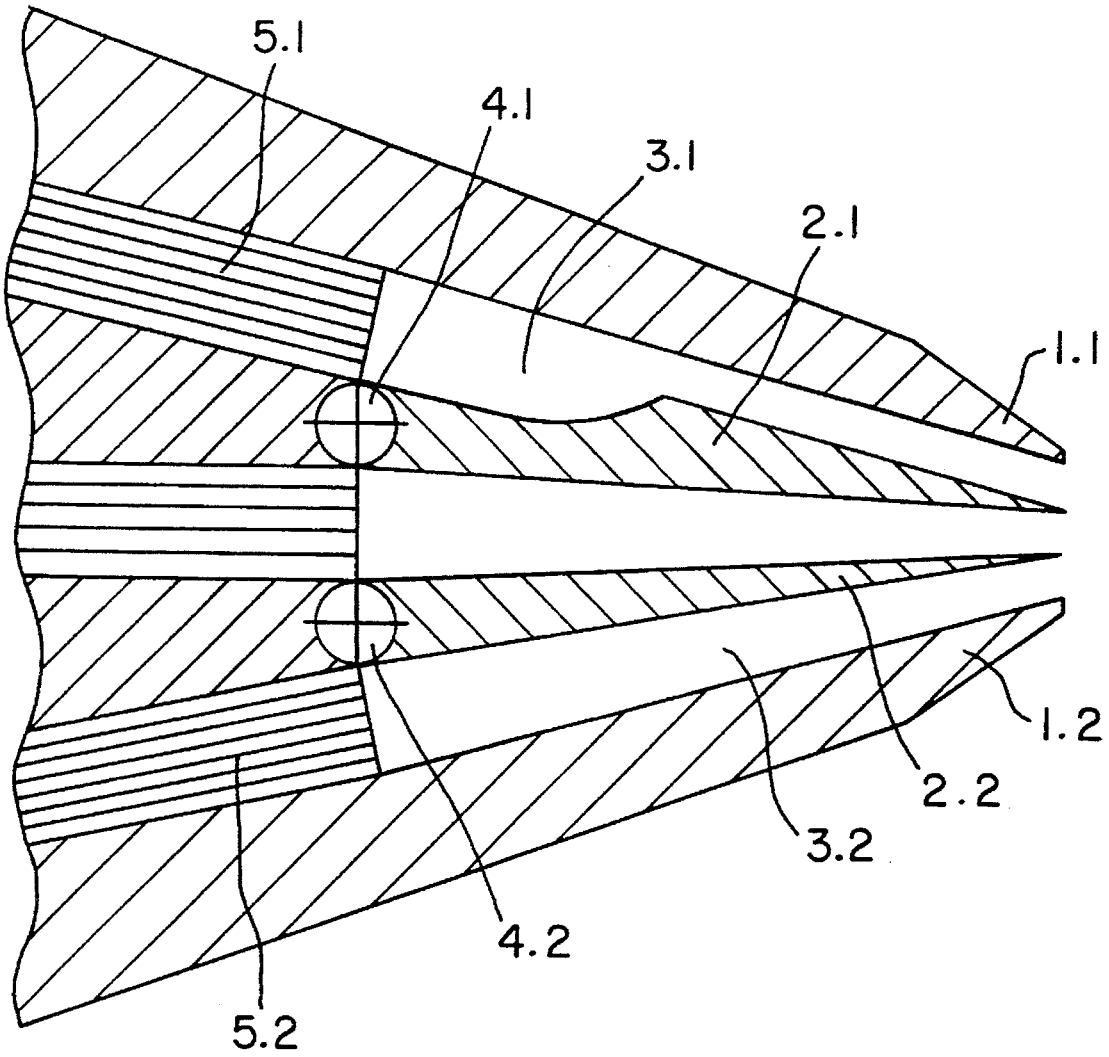

FIG. 3 shows again a triple-layer slice nozzle as in FIG. 2, using same references. It differs from FIG. 1 by the adjustable aperture 6.1 on the upper lip of the headbox.

Figure 3:
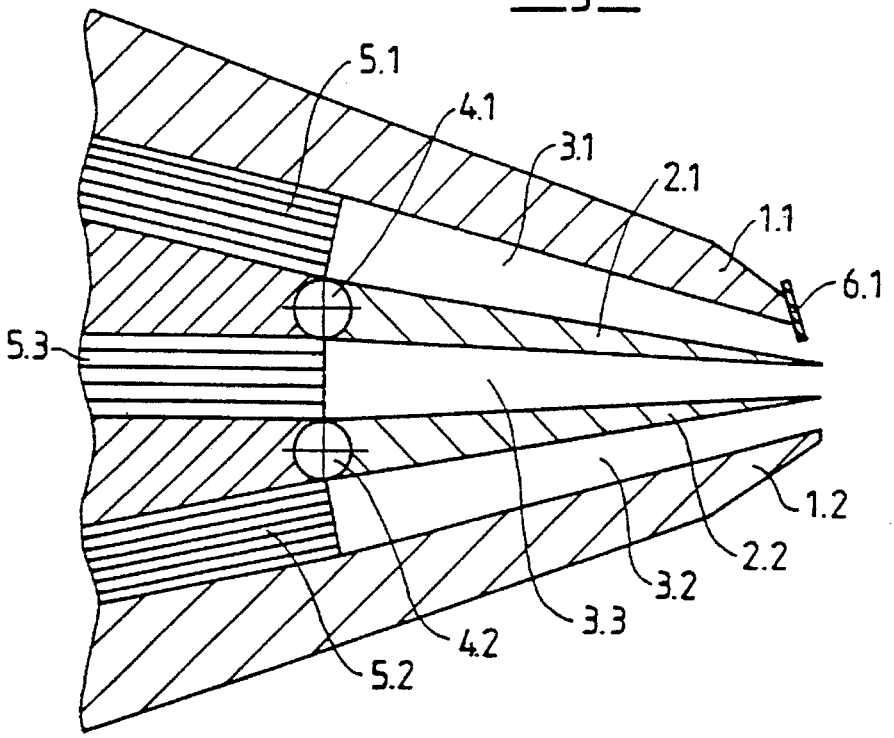
FIG. 3, individual nozzles with different coefficients of resistance and equal geometry.
Figure 4:
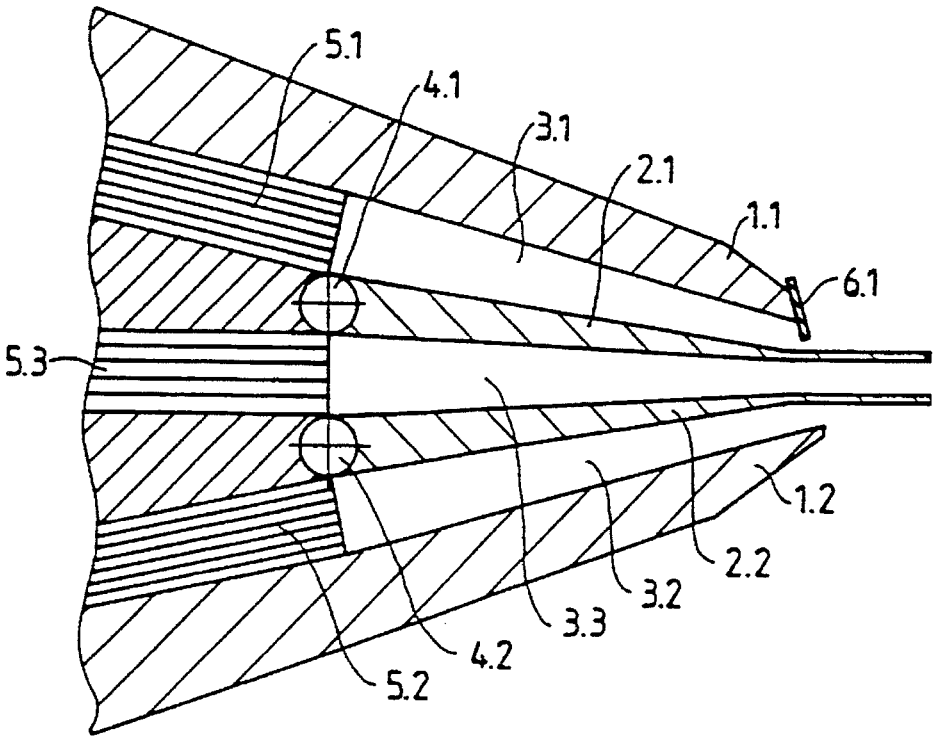
FIG. 4, individual nozzles with different coefficients of resistance and different geometries.

FIG. 4 shows a triple-layer slice nozzle such as in FIG. 3, using identical references. It differs from FIG. 3 in that here the two lamellae extend outward beyond the slice gap formed by the upper and lower lip, thereby generating, due to the pressure conditions, an expansion of the center nozzle 3.3 and a decrease in flow velocity.

We claim:

1. A multilayer headbox for adjusting the relative flow velocity of the stock suspension layers of a multilayer headbox of a paper machine wherein rigid lamellae are mounted during operation between respective rigid and operationally immovable upper and lower lips, said upper and lower lips each having two sides and being joined by side parts, said upper and lower lips and side parts defining a nozzle for flow of the stock suspension layers, wherein n flow channels are provided, with $n \geqq 2$ and wherein $n-1$ lamellae extend across the machine width in the nozzle transverse to the direction of flow of the stock suspension layers, said lamellae having respective length sides directed upstream and being mounted with no-moment mounting on said length sides, said lamellae further comprising boundaries between individual stock suspension layers, said flow channels each having a cross section and further having respective entrance and exit cross sections, wherein the improvement comprises:

at least one of said lamellae has a generally overall convex profile on one of said sides, viewed in the direction of flow of the stock suspension, structured so that a point of constriction is formed in the flow channel bounded by said generally convex profiled side of the lamellae, thereby narrowing said cross section at said constricted portion when compared to said entrance cross section.

2. The multilayer headbox of claim 1, wherein said upper lip includes an adjustable aperture.

3. The multilayer headbox of claim 1, wherein said lamellae protrude beyond the nozzle defined by the upper and lower lips.

4. The multilayer headbox of claim 2, wherein said lamellae protrude beyond the nozzle defined by the upper and lower lips.

5. The multilayer headbox of claim 1, wherein said lamellae terminate at an exit opening of the nozzle defined by the upper and lower lips.

6. A multilayer headbox for adjusting the relative flow velocity of the stock suspension layers of a multilayer headbox of a paper machine wherein rigid lamellae are mounted during operation between respective rigid and operationally immovable upper and lower lips, said upper and lower lips each having two sides and being joined by side parts, said upper and lower lips and side parts defining a nozzle for flow of the stock suspension layers, wherein n flow channels are provided, with $n \geqq 2$ and wherein $n-1$ lamellae extend across the machine width in the nozzle transverse to the direction of flow of the stock suspension layers, said lamellae having respective length sides directed upstream and being mounted with no-moment mounting on said length sides, said lamellae further comprising boundaries between individual stock suspension layers, said flow channels each having a cross section and further having respective entrance and exit cross sections, wherein the improvement comprises:

at least one of said lamellae has a generally overall concave profile on one of said sides, viewed in the direction of flow of the stock suspension, structured so that a widened portion is formed in the flow channel bounded by said generally concave profiled side of the lamellae, thereby increasing said cross section at said widened portion when compared to said entrance cross section.

7. The multilayer headbox of claim 6, wherein said upper lip includes an adjustable aperture.

8. The multilayer headbox of claim 6, wherein said lamellae protrude beyond the nozzle defined by the upper and lower lips.

9. The multilayer headbox of claim 7, wherein said lamellae protrude beyond the nozzle defined by the upper and lower lips.

10. The multilayer headbox of claim 6, wherein said lamellae terminate at an exit opening of the nozzle defined by the upper and lower lips.

* * * * *